US006748957B1

(12) United States Patent
Giordano

(10) Patent No.: US 6,748,957 B1
(45) Date of Patent: Jun. 15, 2004

(54) PRODUCT APPLICATOR FOR MULTICOLOR HAIR TREATMENT

(76) Inventor: Giuseppe Giordano, 31, ch. de Pernessy, Le Mont sur Lausanne VD (CH), CH-1052

( * ) Notice: Subject to any disclaimer, the term of this patent is extended or adjusted under 35 U.S.C. 154(b) by 0 days.

(21) Appl. No.: 09/868,869

(22) PCT Filed: Oct. 13, 1999

(86) PCT No.: PCT/CH99/00484

§ 371 (c)(1),
(2), (4) Date: Mar. 11, 2003

(87) PCT Pub. No.: WO00/22954

PCT Pub. Date: Apr. 27, 2000

(30) Foreign Application Priority Data

Oct. 17, 1998 (CH) ..... 2089/98

(51) Int. Cl.[7] ..... A45D 24/22
(52) U.S. Cl. ..... 132/112; 132/270; 401/265
(58) Field of Search ..... 132/108, 109, 132/110, 111, 112, 113, 114, 115, 116, 125, 208, 317, 320, 270; 401/10, 261, 263, 265, 266; D28/7, 10

(56) References Cited

U.S. PATENT DOCUMENTS

| | | | | | |
|---|---|---|---|---|---|
| 371,133 | A | * | 10/1887 | Fisher | 401/17 |
| 4,727,893 | A | * | 3/1988 | Goncalves | 132/320 |
| 4,738,669 | A | * | 4/1988 | Vlock | 604/289 |
| 4,966,483 | A | * | 10/1990 | Hashimoto et al. | 401/206 |
| 5,035,251 | A | * | 7/1991 | Hollenberg et al. | 132/112 |
| 5,059,050 | A | * | 10/1991 | Guglielmo | 401/171 |
| 5,060,679 | A | * | 10/1991 | Christopher et al. | 132/114 |
| 5,067,501 | A | * | 11/1991 | Auger | 132/116 |
| 5,102,248 | A | * | 4/1992 | Welschoff | 401/50 |
| 5,676,480 | A | * | 10/1997 | Tosto | 401/10 |
| 5,762,077 | A | * | 6/1998 | Griffiths, Jr. | 132/74.5 |
| 5,888,005 | A | * | 3/1999 | Gueret | 401/128 |
| 6,450,985 | B1 | * | 9/2002 | Schoelling et al. | 604/15 |

* cited by examiner

*Primary Examiner*—Eduardo C. Robert
*Assistant Examiner*—David Comstock
(74) *Attorney, Agent, or Firm*—Giuseppe Giordano

(57) ABSTRACT

The invention concerns an applicator (5) with its end part having a conical or polyhedral shape (1) which enables, when it is facing downwards to retain the product and to allow a lock of hair to be inserted into a slot (2) for treating it to modify the colour of the lock of hair.

6 Claims, 1 Drawing Sheet

PRODUCT APPLICATOR FOR MULTICOLOR HAIR TREATMENT

The invention relates to an applicator of liquid or paste products for hair treatment. The applicator can be used to modify the colour of locks of hair.

BACKGROUND OF THE INVENTION

The present invention relates to a conical applicator, which can be used to apply a treatment product to a head of hair to modify the colour of the whole head of hair or of parts thereof.

For this treatment operation, a certain number of applicators are known, such as combs, slides, brushes, blades, caps, and other equipment; they all have drawbacks in respect of effects which are not suitable for the present art, for example the delimitation of the locks which is angular by default, the operation being imperfect and the dye frequently runs off to one side and in many cases causing stains and irritation of the scalp. More importantly, it does not enable the dye to be applied all around the lock of hair. The hair is irregularly coated with the dye, which removes its brilliance.

The poor adaptation to the present art increases the time-intensiveness for the user.

This is particularly true of the applicator according to patent application EP 0 224 395 A1 of Oct. 7, 1986:

- its fork having different linked elements and a supply of product being fed through an aperture, the whole being operated by the user makes the operation very complicated and inefficient.

The invention would be very difficult to produce and the cost would be inappropriate for the circumstances.

There are two other known patents, U.S. Pat. No. 5,059,050 of Oct. 22, 1991 and U.S. Pat. No. 5,060,679 of Oct. 29, 1991, these two patents having linked elements and the treatment being pushed through an aperture to be applied, then drawn along the lock of hair, the treatment can never be applied in the opposite direction.

U.S. Pat. No. 5,067,501 of Nov. 26, 1991 can also be cited.

- a fork on the tip of the dispenser, activated by pressure on a flexible applicator, can be used to spread a trail of treatment on the lock of hair, but cannot be applied in the opposite direction in any circumstances.

This is also the case with Patent DE 3704936 A1 of Aug. 25, 1988:

- a row of teeth having at their bases one or more holes enabling one or more trails of dye to be created on the hair; not having any means of delimiting the locks or of treating the whole lock of hair. The holes can never apply the treatment in the opposite direction.

All the existing systems for treating locks of hair have the object of modifying the colours of locks of hair, without enabling the dye to have an all around effect, since none of these systems can apply the dye around the whole lock of hair.

BRIEF DESCRIPTION OF THE DRAWINGS

The drawing in FIG. 1 represents one embodiment of the applicator.

DESCRIPTION OF PREFERRED EMBODIMENT

Figure 1:
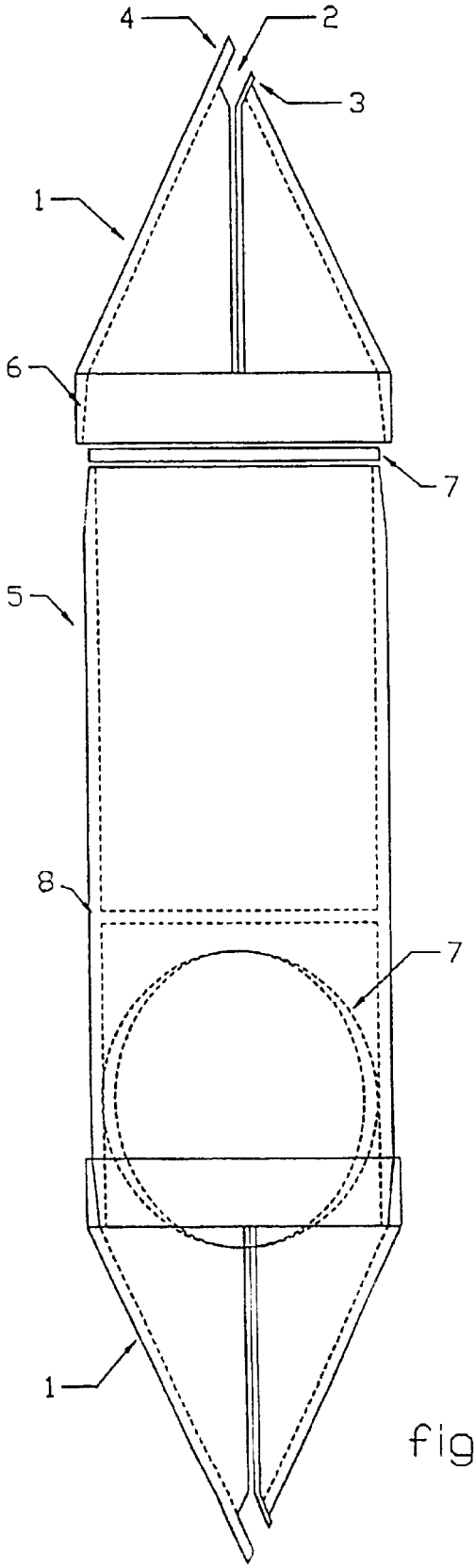

The cone 1 provides a summary where all the active elements are represented. The delimiting point 4 can be used to prepare a lock for insertion in the slit 2. The slit 2 terminates in an opening which enables the lock of hair to be inserted without any difficulty. The lip 3 extends over the whole length of the slit 2, or part thereof, and prevents the product from running to the side of the delimited lock. The casing 6 enables the two parts 1 and 5 to be assembled, leaving a space between them for the insertion of the blank washer 7 for mixing the different treatment products.

The washer 7, when fixed between the cone 1 and the body 5, allows the treatment product to be agitated without leaking out of the insertion slit 2. When the liquid has been mixed, and before use, the flexible washer 7 is turned to the vertical position and allowed to move into the body 5.

The point 8 is the embodiment of a double applicator for applying twin dyes to a lock of hair.

The applicator in FIG. 1, with its simple design with walls A of uniform thickness, makes it possible to have a modest production cost and simple maintenance for hygiene (cleaning).

The present invention proposes an applicator which enables the treatment product or products to be applied in a regular way to the locks of a head of hair. This applicator terminates in a conical or polyhedral shape, made in two parts, designed to be assembled by fitting together (Fig. $J_1$ 5 and 6). A flexible washer 7 is placed in the closure of the body containing the treatment product at the point of fitting, in such a way that the product can be agitated in one of the parts of the applicator. Subsequently, before use, the flexible washer 7 is turned to the vertical position and the product is released to pass into the whole of the container, and particularly into the part affected by the invention, towards the forward end of the cone.

The conical part (FIG. 1, item 1), its natural conical shape makes it possible to create a delimiting point 4, an opening 2, followed by a slit extending towards the centre over almost the whole length of the cone, permits insertion from the opening into the slit over a variable length, depending on the depth of insertion of the lock into the slit.

When its end is turned downwards, this tool enables the user to delimit the locks of hair by means of the point 4, and to determine the exact point at which the user wishes to modify the colour.

Its conical shape 1 allows an easy approach for inserting the lock of hair into the opening 2, towards the slit, and since the cone is filled with treatment product the lock is coated with product and the surplus treatment is wiped off as the lock leaves the slit, because of the design of the narrow shape of the latter.

What is claimed is:

1. Applicator of a liquid or paste product for hair treatment, comprising a body (5) terminating in at least one end (1) for the application of the treatment product, characterized in that the end is conical or polyhedral in shape and terminates in a point (4) or a ridge, in that a through slit parallel to the longitudinal axis of the applicator is made in the end from the connection of the end to the body and up to an opening (2) in the upper part of the end, and in that the said end has walls of uniform thickness from the base to the top so that in the position in which the applicator is used with the end turned downwards, the product completely fills an inner conical or polyhedral space and permits all-around, submerged treatment of a lock of hair within the space when inserted from the opening into the slit over a variable length which depends on the depth of insertion of the lock into the slit.

2. Applicator according to claim 1, characterized in that the end is of pyramidal shape.

3. Applicator according to one of the preceding claims, characterized in that the point (4) of the conical end serves to delimit a lock of hair inserted into the opening.

4. Applicator according to claim 1, characterized in that lips (3) are formed on the opening to prevent the product from running to the side of the delimited lock.

5. Applicator according to claim 1, characterized in that the end is designed to be fitted (6) on the body.

6. Applicator according to claim 5, characterized in that a flexible washer (7) is placed in the closure (6) of the body containing the treatment product, at the point of the fitting, in such a way that the treatment product can be agitated and the flexible washer (7) can subsequently be turned to the vertical position before use.

* * * * *